United States Patent [19]

Yokota

[11] Patent Number: 5,051,713

[45] Date of Patent: Sep. 24, 1991

[54] WAVEGUIDE FILTER WITH COUPLED RESONATORS SWITCHABLY COUPLED THERETO

[75] Inventor: Shigetoshi Yokota, Thousand Oaks, Calif.

[73] Assignee: Transco Products, Inc., Camarillo, Calif.

[21] Appl. No.: 292,091

[22] Filed: Dec. 30, 1988

[51] Int. Cl.[5] ..... H01P 1/10; H01P 1/209

[52] U.S. Cl. ..... 333/212; 333/230; 333/259

[58] Field of Search ..... 333/212, 208–210, 333/230, 232, 258, 262, 259

[56] References Cited

U.S. PATENT DOCUMENTS

| | | | |
|---|---|---|---|
| 2,432,093 | 12/1947 | Fox | 333/212 X |
| 3,119,083 | 1/1964 | Fuss | 333/230 |
| 3,164,792 | 1/1965 | Georgiev et al. | 333/209 |
| 3,444,486 | 5/1969 | Banes et al. | 333/232 |
| 3,544,927 | 12/1977 | Elder et al. | 333/209 |
| 4,251,787 | 2/1981 | Young et al. | 333/212 X |
| 4,652,844 | 3/1987 | Brombilla | 333/212 |

FOREIGN PATENT DOCUMENTS

| | | | |
|---|---|---|---|
| 10802 | 1/1988 | Japan | 333/209 |

*Primary Examiner*—Eugene R. LaRoche
*Assistant Examiner*—Benny Lee
*Attorney, Agent, or Firm*—Charles H. Schwartz; Ellsworth R. Roston

[57] ABSTRACT

A waveguide filter switch, including a waveguide transmission path for electromagnetic energy. At least one series resonator filter positioned in shunt with the transmission path. At least one coupling aperture in the waveguide for coupling the at least one series resonator to the waveguide. A switching positioned across the coupling aperture and having an open state wherein the coupling aperture is electrically open to provide for coupling the series resonator to the waveguide and having a closed state wherein the coupling aperture is electrically shorted to prevent coupling of the series resonator to the waveguide. The switch including a sliding member physically located to have an open retracted position wherein the coupling aperture is physically unencumbered to produce the open state for the switch and to have a closed extended position wherein the coupling aperture is physically encumbered to produce the closed state for the switch.

34 Claims, 2 Drawing Sheets

FIG. 5
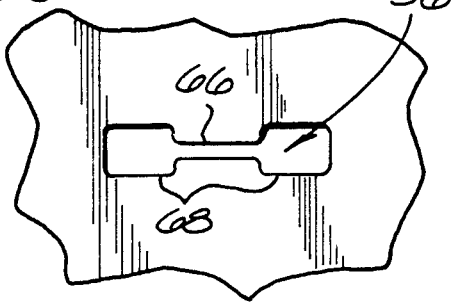
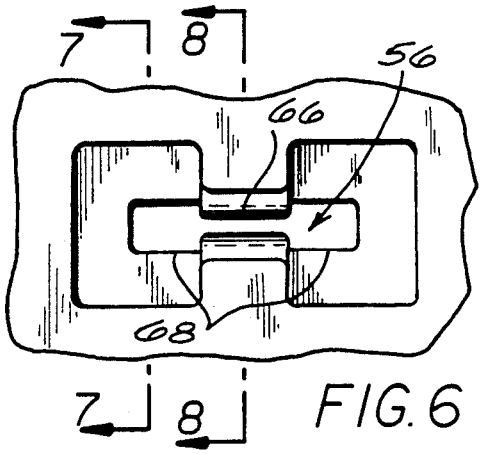
FIG. 6
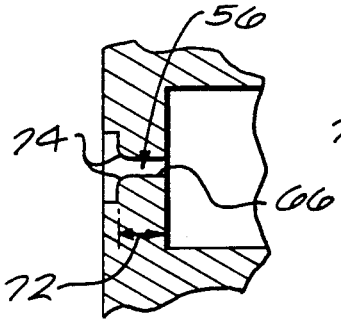
FIG. 8
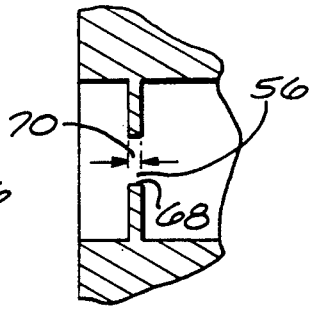
FIG. 7
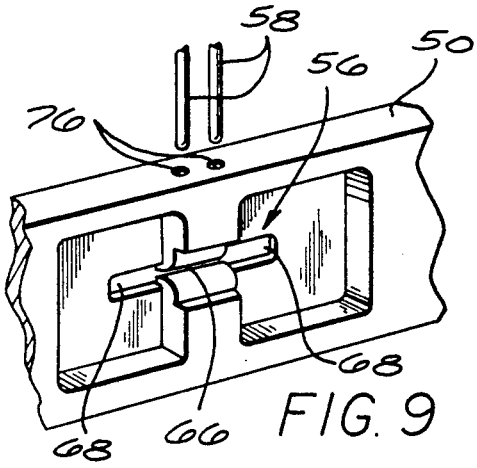
FIG. 9
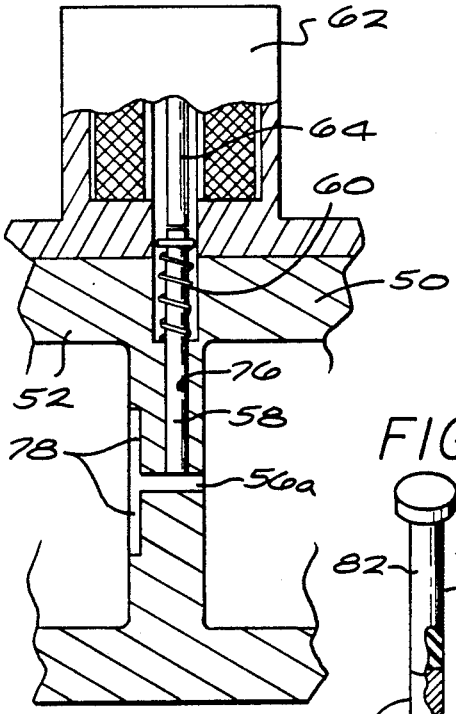
FIG. 10
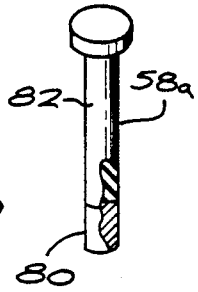
FIG. 11
FIG. 12(a)
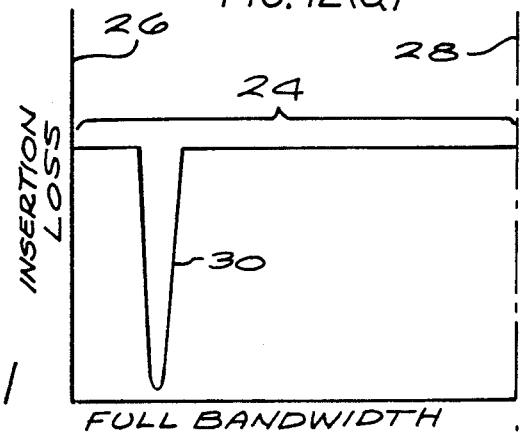
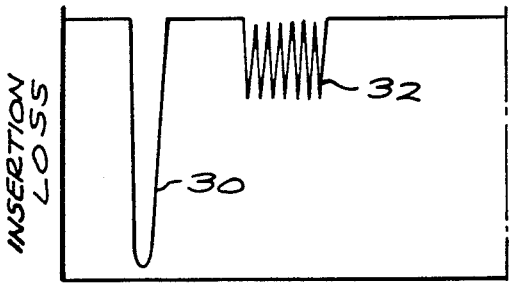
FIG. 12(b)

WAVEGUIDE FILTER WITH COUPLED RESONATORS SWITCHABLY COUPLED THERETO

BACKGROUND OF THE INVENTION

1. Field of the Invention

The present invention relates to a waveguide filter with integral switching capability. Specifically, the present invention provides for a waveguide filter/-switch with high power handling capability, hot switching and fast switching speed while maintaining optimum RF performance.

2. Description of the Prior Art

In general, prior art waveguide filters with integral switching capabilities have fallen into two types. One type uses an integration of discrete coaxial and/or waveguide switches and filters using RF cables and connectors which may or may not include quick disconnect techniques so that various elements of the switches and filters may be added or removed. The disadvantages of such devices are as follows. If coaxial components are used, these provide for poor power handling capability, negligible hot switching capability and poor RF performance. If waveguide components are used, these provide for slow switching time, limited hot switching capability, degraded RF performance and a large envelope size.

The other type of prior art device incorporates the use of resonators coupled to a coaxial or waveguide line to provide for filtering capability and with the use of diodes located across the resonators to provide for switching capability. The use of the switching diodes, however, provides a number of disadvantages. Specifically, the diodes cannot handle high power and the location of the diodes across the resonators does affect and degrade the performance of the filtering produced by the resonator itself. Specifically, the diode broadens out the bandpass or bandstop provided by the resonator.

Other types of prior art devices use other types of tuning or detuning members to effect the performance of the resonator, but do not provide for the desired high power handling capability, hot switching and fast switching. In addition to the above, reed switches have been used across the tuning resonator, but again such reed switches cannot provide for the desired high power handling capability with minimum degradation of the operation of the resonator.

References is made to the following prior art patents which disclose, some of the above described techniques. Karp U.S. Pat. No. 4,066,988; Wehner U.S. Pat. No. 3,521,199; Funck et al U.S. Pat. No. 4,642,584; Peppiatt U.S. Pat. No. 3,546,633; and Kouroda et al U.S. Pat. No. 3,569,874.

SUMMARY OF THE INVENTION

The present invention provides for a waveguide filter with integral switching capability having high power handling capability, hot switching and fast switching while maintaining the optimum RF performance. The filters of the present invention are compact, reliable, reproduceable and may be cascaded to form a complex switching filter bank.

The waveguide switching filters of the present invention are provided using one or more series resonators located on the side walls of the waveguide in shunt with the transmission throughpath. The waveguide may either be rectangular or double ridge waveguide and with the resonators coupled to the side walls of the throughpath using irises having a particular and unique shape and configuration. Specifically in a preferred embodiment, the irises have a dumbbell shape with a relatively narrow center section for the dumbbell. In addition, but with the center section of the dumbbell has a greater thickness than the outer sections of the dumbbell.

In order to provide for the desired switching capability, at least one or more pin members are located within the iris structure and specifically pass through the thicker center section to extend across the iris opening. The pin members therefore have an open position with the pins removed from the iris opening and where the dumbbell operates in a normal manner to couple the series resonator in shunt to the waveguide throughpath and thereby provide the desired filtering. The pin members also have a closed position where the pin members extend across the iris opening to short out the dumbbell to provide a switch to eliminate the filtering capability of the resonator.

Therefore, if the pin members in all of the resonators are in the closed position to short out the resonators, a complete throughpath is provided through the waveguide. If the pin members in all of the resonators are in the open position to expose the irises and thereby the resonators, a filtered path results with all of the resonators providing filtering. It is also obvious that individual ones of the resonators may be thereby switched into and out of operation and, thereby, provide for particular filtering depending on the specific resonators in operative engagement with the waveguide. Therefore, various filtering combinations may be provided at will in accordance with the specific switching combinations.

The use of the specifically designed iris structure of the present invention provides for the particular desired result. Typically, a resonator produces not only the desired filtering at a particular desired frequency, but also second order resonant frequencies which can be within the bandpass of the waveguide. Therefore, the resonator not only provides for the desired filtering, but also provides for undesired second order filtering within the waveguide bandpass.

The specifically shaped dumbbell iris of the present invention eliminates the second order resonances while at the same time, allowing for high power handling capability. This is because the second order resonances are affected mainly by the size and shape of the center section of the dumbbell iris. If the iris is designed to be a uniform thickness throughout its length, the height of the opening of the center section would have to be made very small in order to provide for the elimination of the second order resonances. When the height of the opening of the center section is too small, then the power handling capability of the waveguide filter is reduced. If, however, the height of the opening of the iris in the center section is made larger, then the second order resonances are not eliminated within the bandpass of the waveguide.

In the present invention, the height of the opening of the center section is made large enough to provide for high power handling capability, but the thickness of the center section of the iris is increased relative to the outside sections of the iris in order to eliminate the second order resonances. In general, the thickness of the center section is at least twice and preferably more than three times the thickness of the outside sections of the dumbbell iris. Similarly, the height of the outside sections of the iris is at least twice and preferably more than three times the height of the center section of the dumbbell iris.

The use of a thicker portion for the center section of the dumbbell iris also allows a sufficient depth to comfortably receive the pin member to short out the iris and thereby eliminate the effect of the resonator when desired. Therefore, the provision of the greater thickness of the center section relative to the outer sections of the iris has a double effect of allowing for the switching capability using the pin members and also providing the optimum RF performance by the elimination of the second order resonances which degregates the performance of the filter.

BRIEF DESCRIPTION OF THE DRAWINGS

A clearer understanding of the present invention will be had with reference to the following description and drawings wherein:

FIG. 5 is a front view of a typical iris provided in FIG. 4 to couple the main waveguide to the shunt resonator;

FIG. 6 is a back view of the iris shown in FIG. 5;

FIG. 7 is a cross sectional view of the iris of FIGS. 5 and 6 taken along lines 7—7 of FIG. 6;

FIG. 8 is a cross sectional view of the iris of FIGS. 5 and 6 taken along lines 8—8 of FIG. 6;

FIG. 9 is a back perspective view of the iris of FIGS. 5 and 6 and which clearly shows an increased thickness in the center section of the iris;

FIG. 10 is a cross sectional view of a second embodiment of the iris of the present invention and also showing in detail the operation of a pin member as part of a switching mechanism to short out the iris;

FIG. 11 is an illustration of a second embodiment for a pin member to provide for the switching and with the second embodiment of the pin member including both dielectric and conductive portions; and FIG. 12(*a*) illustrates the operation of the resonator of the present invention in eliminating the second order resonances and FIG. 12(*b*) illustrates the operation of the prior art.

DETAILED DESCRIPTION OF THE DRAWINGS

Figure 1:
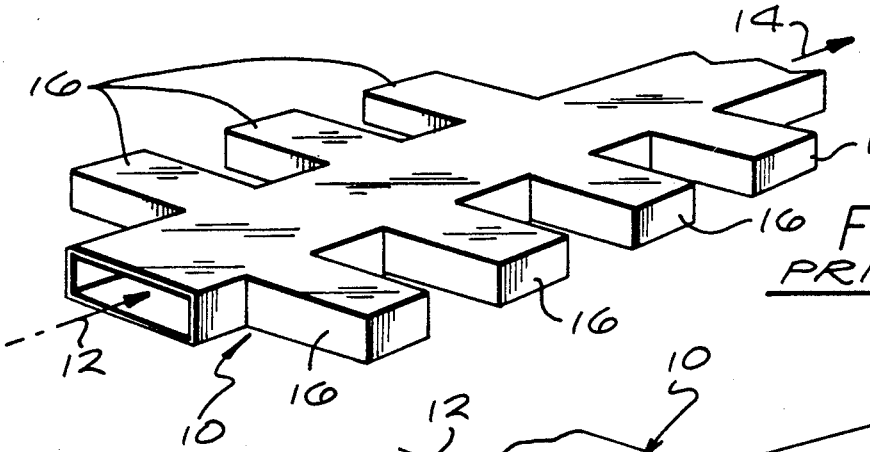
FIG. 1 PRIOR ART
FIG. 1 illustrates a typical rectangular waveguide with a plurality of resonators.

As illustrated in FIG. 1, a rectangular waveguide 10 has a throughpath as shown by the arrows 12 and 14. A plurality of series resonators 16 are shown disposed along the side walls in shunt with the transmission throughpath of the waveguide 10.

Figure 2:
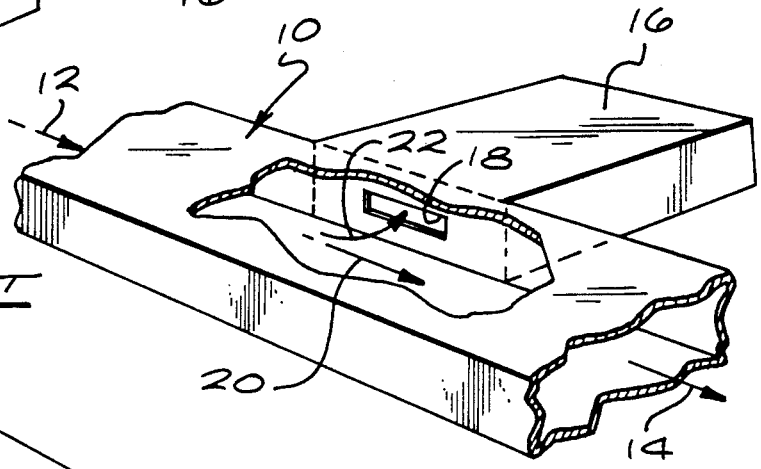
FIG. 2 PRIOR ART
FIG. 2 illustrates a detail of FIG. 1 partially broken away to show a typical resonator with a rectangular iris opening.

Referring now to FIG. 2 there is illustrated a single one of the resonators 16 disposed along the side wall of the waveguide 10. An iris 18 is provided in the side wall of the waveguide 10 to allow for communication of energy to the resonator 16 from the throughpath of the waveguide. This communication of energy is shown by arrows including an arrow 20 which is part of the throughpath and an arrow 22 which represents the portion of the energy which is shunted into the series resonator 16. Depending upon the particular characteristics of the resonator, such as the size and shape of the resonator 16 and the size and shape of the iris 18, the resonator produces a filtering action such as an insertion loss within the typical operation bandwidth of the energy transmitted along the waveguide 10. It is to be appreciated, that although the waveguide 10 is shown to be a normal rectangular waveguide, other forms of waveguide such as double ridge waveguide may also be used to accomplish the same result.

FIGS. 12(*a*) and 12(*b*) illustrate a typical bandwidth for electromagnetic energy in a waveguide, such as the waveguide 10 shown in FIGS. 1 and 2, or for other waveguides illustrated in the present application. The bandwidth is represented as the distance 24 between the dotted lines 26 and 28. Also, as illustrated in FIGS. 12(*a*) and 12(*b*) a filter notch 30 or insertion loss is shown to be produced within the bandwidth of energy and with this filter notch 30 accomplished through the use of the resonator such as the resonator 16. The width of the filter notch, the amount of rejection of energy provided by the filter notch and the frequency position of the filter notch within the bandwidth may all be adjusted depending upon the size and shape of the resonator 16 and the iris 18.

Unfortunately, in addition to the production of the desired filter notch 30, the prior art devices also provided for second order resonances 32 as shown in FIG. 12(*b*). As can be seen, the frequency of the second order resonances 32 are also within the bandwidth of the energy in the waveguide 10. The second order resonances, therefore, are unwanted since they provide for an undersired filtering action within the bandwidth. The present invention, therefore, provides for the elimination of the second order resonances 32 by the use of a specially shaped iris so that the frequency of the second order resonances are moved to a frequency position outside of the bandwidth 24 so that the second order resonances do not disturb the performance of the filtering capability of the various shunt resonators.

In addition to the above, the present invention also provides for a novel structure by which individual ones of the resonators may be switched into and out of operation so as to include or eliminate the filter notch 30 in the bandwidth 24 as shown in FIG. 12(*a*). The particular switching capability of the present invention is accomplished without degrading the performance and specifically without degrading the sharp shape of the filter notch 30. The particular embodiments of the present invention will be described with reference to a double ridge waveguide, but as indicated above, other types of waveguides such as rectangular waveguides may also be used.

Figure 3:
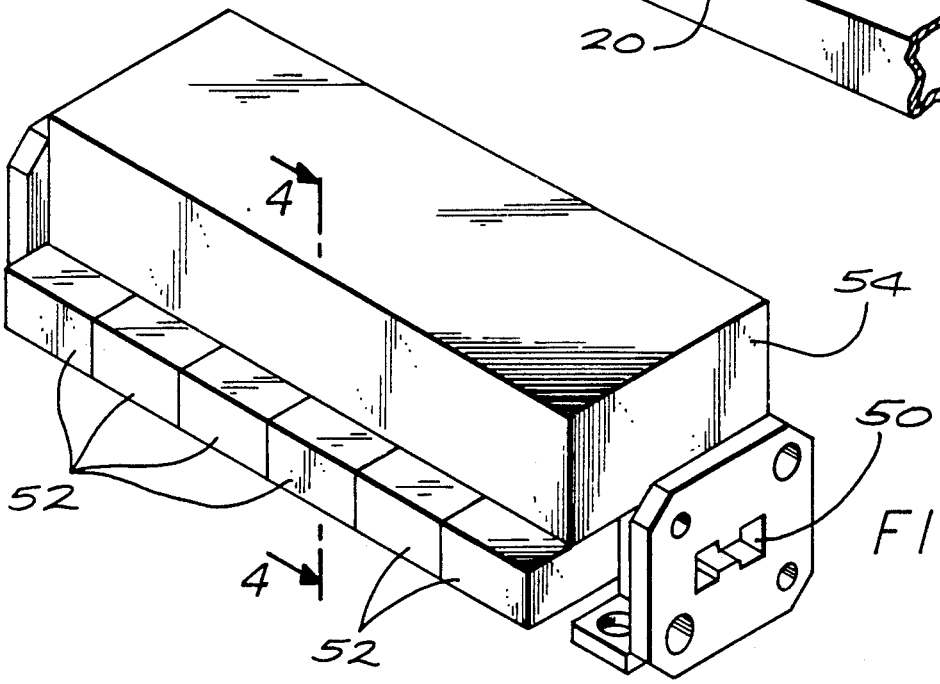
FIG. 3 illustrates an overall view of a double ridge waveguide including resonators and incorporating the features of the present invention.

FIG. 3 illustrates an overall envelope configuration for the filter/switch of the present invention. As can be seen in FIG. 3, a double ridge waveguide 50 has a plurality of resonators 52 disposed along one side. Each of the individual resonators provides a frequency notch similar to the notch 30 shown in FIGS. 12(*a*) and 12(*b*) but with each notch at a different frequency. Positioned above the waveguide 50 and the resonators 52 is a housing 54 which housing 54 encloses the switching mechanism of the present invention.

Figure 4:
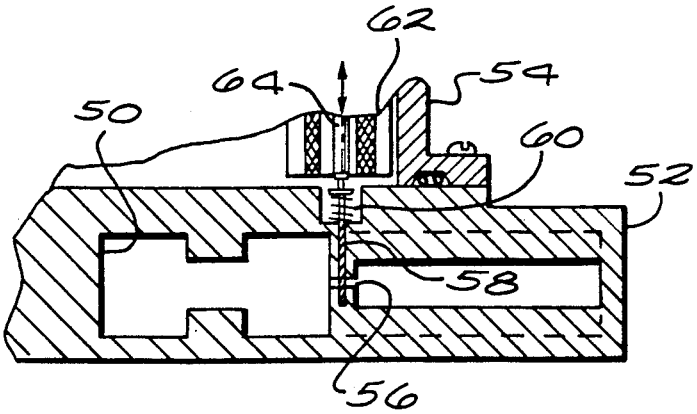
FIG. 4 is a cross sectional view of FIG. 3 taken along lines 4—4 of FIG. 3.

FIG. 4 illustrates a cross sectional view taken along lines 4—4 of FIG. 3 and illustrates one of the resonators 52 positioned along one side wall of the double ridge waveguide 50. As can be seen in FIG. 4, an iris 56 provides communication between the waveguide 50 and resonator 52. The details, such as the shape and size of the iris, which form the specific configuration of the iris 56 will be described with reference to additional drawings of this specification. However, it can also be seen in FIG. 4 that at least one spring biased pin member 58 is positioned to pass through to, when desired, short out the iris 56.

The spring biasing member for the pin member 58 is provided by helical spring 60, but it is to be appreciated that other types of spring members such as flat springs could be used. Also, the pin member 58 may be biased downward by the spring to normally short out the opening of the iris 56.

The actuation of the pin member 58 is produced by a solenoid 62 which is of a conventional type and includes an actuator 64. The pin member may be actuated downward, as shown in FIG. 4, to short out the opening of the iris 56 by the operation of the solenoid 62 through the solenoid actuator 64. Alternately, the spring may bias the pin downward and the solenoid 62 used to pull the pin upward.

When the solenoid 62 is deactivated the spring member 60 will bias the pin member 58 and solenoid actuator 64 upward so that the opening through the iris 56 is exposed. This allows for energy in the waveguide path to be shunted through the iris into the series resonator 52 to provide for the filtering notch, such as the filtering notch 30 shown in FIG. 12(*a*). When the pin member 58 is actuated to the downward position, as shown in FIG. 4, the opening across the iris 56 is shorted out so that the path for the energy into the resonator 52 is eliminated.

The use of the pin members accomplishes a switching action without degrading the performance of the resonator. In the upper deactuated position, the pin member is substantially invisible to the electrical energy and does not form part of the electrical filtering circuit. In the downward actuated position, the shunt path into series resonator 52 for the electromagnetic energy is effectively shorted out. It can be seen, that the use of the pin members provides for a very compact structure which is reliable in operation and reproduceable in effect for each time of operation. The pin members may be provided for each of the plurality of resonators arranged along the side wall of the waveguide 50 as shown in FIG. 3 and with individual resonator switched into or out of operation to provide for specific filtering. The use of the pin members also provides for high power handling capability, hot switching capability and fast switching speed while maintaining the optimum RF performance of the waveguide 50 and resonators 52.

FIGS. 5–9 illustrate in greater detail the size, shape and special structural configuration for the iris 56. Specifically, the iris 56 is shown to have a dumbbell shape with a small center section 66 flanked by larger outer sections 68. From the front view of the iris shown in FIG. 5, the iris appears to have a somewhat conventional shape except for the center section 66 being smaller in height than conventional dumbbell configurations. In general, the height of the center section 66 is kept relatively small, but not so small so as to reduce the high power handling capability of the waveguide structure. In general, the height of the center section 66 will be less than one half ($\frac{1}{2}$) of the height of the outer sections 68 and preferably less than one third ($\frac{1}{3}$).

It should also be noted that the center section may be provided with a plurality of areas of reduced height and may not be formed of a single center section. Also, it is to be appreciated that the structure may be reversed by having a large center section and small outer sections, but now with the outer sections having a substantially reduced height relative to the center section. It is the combination of the provision of an iris having varying heights for different portions of the iris and with at least one portion of the iris having a substantially reduced height relative to the other portions that forms one of the important characteristics of the present invention.

FIGS. 6–9 illustrate a further characteristic of the iris of the present invention which provides for the additional unique structure to eliminate the effect of the second order resonances as explained above. In particular, the thickness of the center section 66 is much greater then the thickness of the outer sections 68. Specifically, as shown in FIG. 7, the outer sections 68 have a particular thickness which is identified by the reference numeral 70. Similarly, the thickness of the center section 66 is much greater than the outer section and this greater thickness is identified by the reference numeral 72. Actually, the center section 66 is shown to have a stepped configuration to provide for a smoother transition of the energy into the interior of the resonator. Further, the center section 66 includes chamferred or rounded off inner portions 74 additionally to aid in this transition of the energy to the resonator. Specifically, sharp corners create high electric field intensity around the sharp corners which tends to cause voltage breakdown. The rounding off thereby reduces high electric field intensity.

In any event, the section 66 of the iris which has the smaller height relative to the sections 68 also has the greater thickness. It can be seen, therefore, that the thickness of the center section 66 is much greater than the thickness of the outer sections 68. In particular, for the irises of the present invention, the thickness of the section 66 is at least twice as much as the thickness of the sections 68 and preferably three times as much.

Therefore, the ratio between the height of the outer sections 68 and the height of the center sections 66 of the iris 56 is at least two to one end with the thickness of the center section 66 relative to the outer sections 68 also having a ratio of at least two to one. In both instances, the ratio is preferably three to one or more in order to fully achieve the desired result of having the second order resonance moved outside of the bandwidth of the waveguide. This is especially true for filter notches at the lower end of the frequency range of the bandwidth.

FIG. 9 illustrates a back perspective view which shows the structure of the iris 56 located in the side wall of the waveguide 50 and wherein the various height and depth constraints are clearly seen. In addition, in FIG. 9, a pair of pin members 58 are shown to pass through openings 76 in the side wall of the waveguide 50 to provide for the switching of the resonators into or out of the electrical circuit by opening up or shorting out the iris 56. The pin members 58 would be actuated by a solenoid as shown in FIGS. 4 and 10.

FIG. 10 also illustrates a slight modification of the iris and is identified as iris 56(*a*). Specifically, as shown in FIG. 10, the irs 56(*a*) may have even a greater thickness for the center section than the iris 56 shown in FIG. 8. Additionally, the iris 56(*a*) does not have a rounded or chamferred inner-end 74 as shown in FIG. 8, but rather has a sharp inner-end and with a step portion 78 which is larger than the step portion shown for the iris 56 of FIG. 8. It can be seen, therefore, that considerable variations may be provided in the structure of the iris so as to achieve the desired result. As indicated above, the important characteristics are for the iris to have sections of different height and different thickness and with the sections of smaller height also being the sections of greatest thickness and with the ratios being at least two to one for both height and thickness as explained above.

Another slight variation of the invention is shown in FIG. 11 wherein a pin member 58(*a*) is shown to be formed of two portions and specifically, a lower conductive portion 80 and an upper dielectric portion 82. The use of a dielectric portion 82 prevents the unwanted propagation or leakage of electrical energy up through the opening 76 in the waveguide 50 which leakage could produce unwanted disturbances within the bandwidth of the waveguide or degradation of the performance characteristics of the resonator.

It can be seen, therefore, that the present invention provides for waveguide filters with integral switching capabilities and with irises having special characteristics used to couple the waveguide to resonators arranged along the side wall of the waveguide. The present invention also uses shorting pins located within the irises. The combination of the irises with shorting pins provides for high power handling capability, hot switching capability, fast switching speed while at the same time maintaining optimum RF performance. The structure of the present invention is compact, reliable and reproduceable and eliminates many of the deficiencies of the prior art devices.

Although the invention has been described with reference to particular embodiments, it is to be appreciated that various adaptations and modifications may be made and the invention is only to be limited by the appended claims.

I claim:

1. A waveguide filter switch, including a waveguide transmission path, formed by a plurality of wall members, for propagating electrical energy, at least one resonator filter positioned in parallel with the electrical energy along the transmission path and extending from one of the wall members, at least one coupling aperture extending through the one wall member in the waveguide for coupling a corresponding at least one resonator to the waveguide and wherein each coupling aperture is defined by at least one width dimension, one height dimension perpendicular to the width dimension and one thickness dimension of the one wall member, switching means positioned across the height dimension of each coupling aperture and having an open state wherein the coupling aperture is electromagnetically open to provide for coupling the resonator to the waveguide and having a closed state wherein the coupling aperture is electromagnetically shorted to prevent coupling of the resonator to the waveguide, and the switching means including a sliding member physically located within the one wall member to have an open retracted position wherein the coupling aperture is completely physically unencumbered by the sliding member to produce the open state for the switching means and to have a closed extended position wherein the coupling aperture is physically encumbered by the sliding member to produce the closed state for the switching means, and wherein the sliding member is formed by at least one pin member.

2. The waveguide filter switch of claim 1 wherein the waveguide transmission path is a rectangular waveguide.

3. The waveguide filter switch of claim 2 wherein the rectangular waveguide has double ridge configuration.

4. The waveguide filter switch of claim 1 wherein the at least one resonator filter includes a plurality of resonator filters having a plurality of corresponding complementary coupling apertures and a plurality of corresponding complementary switching means.

5. The waveguide filter switch of claim 1 wherein the sliding member comprises the at least one pin member having a plurality of pin members.

6. The waveguide filter switch of claim 1 wherein each of the at least one pin member includes a dielectric portion and a metal end portion.

7. The waveguide filter switch of claim 1 wherein each of the at least one coupling aperture includes at least two sections and with one section having a greater wall thickness dimension relative to the other section having a lesser wall thickness dimension.

8. The waveguide filter switch of claim 7 wherein the pin member is embedded within the section of greater wall thickness dimension.

9. The waveguide filter switch of claim 7 wherein the thickness ratio between the section of greater wall thickness dimension and the section of lesser wall thickness dimension is at least two to one (2/1).

10. The waveguide filter switch of claim 9 wherein the thickness ratio is at least three to one (3/1).

11. The waveguide filter switch of claim 7 wherein the section of lesser wall thickness dimension has a greater height dimension relative to the section of greater wall thickness dimension.

12. The waveguide filter switch of claim 11 wherein each of the one coupling aperture includes a center section and two outer sections to form a dumbbell and with the center section of lesser height dimension and greater wall thickness dimension relative to the outer sections of greater height dimension and lesser wall thickness dimension.

13. The waveguide filter switch of claim 1 wherein each of the at least one coupling aperture includes at least two sections and with one section having a greater height dimension relative to the other section having a lesser height dimension.

14. The waveguide filter switch of claim 13 wherein the switching means is positioned across the section having the lesser dimension.

15. The waveguide filter switch of claim 13 wherein the height ratio between the section having the greater height dimension and the section having the lesser height dimension is at least two to one (2/1).

16. The waveguide filter switch of claim 15 wherein the height ratio is at least three to one (3/1).

17. The waveguide filter switch of claim 13 wherein each of the at least one coupling aperture includes a center section having a lesser height dimension relative to two outer sections having a greater height dimension to form a dumbbell.

18. The waveguide filter switch of claim 17 wherein the switching means is positioned across the center section having the lesser height dimension.

19. The waveguide filter switch of claim 18 wherein the height ratio between the outer sections and the center section is at least two to one (2/1).

20. The waveguide filter switch of claim 19 wherein the height ratio is at least three to one (3/1).

21. A waveguide filter, including a waveguide transmission path, formed by a plurality of wall members, for propagating electrical energy, at least one resonator filter positioned in parallel with the electrical energy along the transmission path and extending from one of the wall members, at least one coupling aperture extending through the one wall member in the waveguide for coupling a corresponding at least one resonator to the waveguide and wherein each coupling aperture is defined by at least one width dimension, two height dimensions perpendicular to the width dimension and two thickness dimensions of the one wall member, each of the at least one coupling aperture including at least two sections and with one section having a greater height dimension and lesser wall thickness dimension relative to another section of lesser height dimension and greater wall thickness dimension to reduce any second order resonances, and a sliding member physically positioned across the lesser height dimension of the coupling aperture to slide between an open retracted position and a closed position to provide switching of the resonator.

22. The waveguide filter of claim 21 wherein the thickness ratio between the section of greater wall thickness dimension and the section of lesser wall thickness dimension is at least two to one (2/1).

23. The waveguide filter of claim 22 wherein the thickness ratio is at least three to one (3/1).

24. The waveguide filter of claim 21 wherein the waveguide transmission path is a rectangular waveguide.

25. The waveguide filter of claim 24 wherein the rectangular waveguide has double ridge configuration.

26. The waveguide filter of claim 21 wherein the at least one resonator filter includes a plurality of resonator filters having a plurality of corresponding complementary coupling apertures and a plurality of corresponding complementary switching means.

27. The waveguide filter of claim 21 wherein the sliding member is at least one pin member.

28. The waveguide filter of claim 27 wherein each the of at least one pin member includes a dielectric portion and a metal end portion.

29. The waveguide filter of claim 21 wherein the height ratio between the section of greater height dimension and the section of lesser height dimension is at least two to one (2/1).

30. The waveguide filter of claim 29 wherein the height ratio is at least three to one (3/1).

31. The waveguide filter of claim 21 wherein each of the at least one coupling aperture includes a center section of lesser height dimension and greater wall thickness dimension and two outer sections of greater height dimension and lesser wall thickness dimension to form a dumbbell.

32. The waveguide filter of claim 31 additionally including the sliding member positioned across the height dimension of the center section.

33. The waveguide filter of claim 32 wherein the ratio of the height dimensions and the ratio of the thickness dimensions are at least three to one (3/1).

34. The waveguide filter of claim 31 wherein the ratio of the height dimensions and the ratio of the thickness dimensions between the outer sections and the center section are at least two to one (2/1).

* * * * *